US008054943B2

(12) United States Patent
Danyluk

(10) Patent No.: US 8,054,943 B2
(45) Date of Patent: Nov. 8, 2011

(54) MAGNETIC COUPLER DRIVE FOR X-RAY TUBE ANODE ROTATION

(75) Inventor: Michael John Danyluk, Waukesha, WI (US)

(73) Assignee: General Electric Company, Schenectady, NY (US)

( * ) Notice: Subject to any disclaimer, the term of this patent is extended or adjusted under 35 U.S.C. 154(b) by 97 days.

(21) Appl. No.: 12/629,936

(22) Filed: Dec. 3, 2009

(65) Prior Publication Data

US 2011/0135065 A1 Jun. 9, 2011

(51) Int. Cl.
*H01J 35/00* (2006.01)

(52) U.S. Cl. ..... 378/131; 378/125

(58) Field of Classification Search ..... 378/119, 378/121, 125, 131

See application file for complete search history.

(56) References Cited

U.S. PATENT DOCUMENTS 4,811,375 A * 3/1989 Klostermann ..... 378/131
6,198,803 B1 * 3/2001 Osama et al. ..... 378/132
7,184,520 B1 * 2/2007 Sano ..... 378/125
7,492,869 B1 2/2009 Qiu et al.
2008/0095316 A1 4/2008 Qiu et al.

FOREIGN PATENT DOCUMENTS

WO 2010136325 A2 12/2010

* cited by examiner

*Primary Examiner* — Jurie Yun

(74) *Attorney, Agent, or Firm* — Ziolkowski Patent Solutions Group, SC

(57) ABSTRACT

An x-ray tube includes a housing enclosing a vacuum chamber, a cathode positioned within the vacuum chamber configured to emit electrons, and an anode positioned within the vacuum chamber to receive the electrons emitted from the cathode and generate a beam of x-rays from the electrons. The x-ray tube also includes a magnetic coupler drive configured to rotate the anode, with the magnetic coupler drive having an inner rotor frame positioned within the vacuum chamber and an outer rotor frame positioned outside the vacuum chamber and adjacent the inner rotor frame. The magnetic coupler drive also includes an inner rotor magnet mounted to the inner rotor frame and an outer rotor magnet mounted to the outer rotor frame. The inner and outer rotor magnets interact to generate a magnetic field that transfers torque from the outer rotor to the inner rotor, thereby causing the inner rotor to rotate the anode.

18 Claims, 4 Drawing Sheets

MAGNETIC COUPLER DRIVE FOR X-RAY TUBE ANODE ROTATION

BACKGROUND OF THE INVENTION

The invention relates generally to x-ray tubes and, more particularly, to a magnetic coupler drive for transmitting torque to the rotating anode of the x-ray tube.

X-ray systems typically include an x-ray tube, a detector, and a bearing assembly to support the x-ray tube and the detector. In operation, an imaging table, on which an object is positioned, is located between the x-ray tube and the detector. The x-ray tube typically emits radiation, such as x-rays, toward the object. The radiation typically passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. One skilled in the art will recognize that the object may include, but is not limited to, a patient in a medical imaging procedure and an inanimate object as in, for instance, a package in a computed tomography (CT) package scanner.

X-ray tubes include a rotating anode structure for the purpose of distributing the heat generated at a focal spot. An x-ray tube cathode provides a focused electron beam that is accelerated across a cathode-to-anode vacuum gap and produces x-rays upon impact with the anode. Because of the high temperatures generated when the electron beam strikes the target, it is necessary to rotate the anode assembly at high rotational speed.

The anode is typically rotated by an induction motor having a cylindrical iron-copper or copper rotor built into a cantilevered axle that supports a disc-shaped anode target and an iron stator structure with copper windings that surrounds an elongated neck of the x-ray tube. Specifically, the rotor resides inside the x-ray tube and is attached to the bearing/anode shaft, with the stator assembly residing outside the x-ray tube in either air or oil for cooling thereof. In operation, the stator functions to generate a magnetic field between the stator and the rotor by having a high current passed through a plurality of windings included therein. The high current passing through the stator windings generates the magnetic field, thereby transmitting torque from the stator to the rotor according to known DC motor principles.

The rotor-stator arrangement of typical x-ray tubes, with the rotor residing inside the x-ray tube and the stator assembly residing outside the x-ray tube, presents limits on the motor efficiency and performance that can be achieved. For example, the large rotor-stator gap resulting from placement of the rotor inside the x-ray tube vacuum and the stator assembly outside the x-ray tube vacuum significantly reduces motor efficiency. Additionally, the rotor-stator arrangement requires cooling mechanisms for cooling the stator windings due to the large currents (e.g., 5-17 amps) needed therein to overcome motor inefficiency.

Therefore, it would be desirable to have a method and apparatus for driving the rotating anode with improved efficiency. It would further be desirable for such an apparatus to operate at a lower temperature, require less input power, and occupy less space outside the x-ray tube housing.

BRIEF DESCRIPTION OF THE INVENTION

The invention is directed to an apparatus, and method of manufacturing thereof, that transmits torque to the rotating anode of an x-ray tube. A magnetic coupler drive is provided that transmits torque from an outer magnetic rotor assembly positioned outside the vacuum chamber to an inner magnetic rotor assembly positioned within the vacuum chamber.

Therefore, in accordance with one aspect of the invention, an x-ray tube includes a housing enclosing a vacuum chamber, a cathode positioned within the vacuum chamber and configured to emit electrons, and an anode positioned within the vacuum chamber to receive the electrons emitted from the cathode and configured to generate a beam of x-rays from the electrons. The x-ray tube also includes a magnetic coupler drive configured to rotate the anode, the magnetic coupler drive further including an inner rotor frame positioned within the vacuum chamber and an outer rotor frame positioned outside the vacuum chamber and adjacent the inner rotor frame. The magnetic coupler drive also includes an inner rotor magnet mounted to the inner rotor frame and an outer rotor magnet mounted to the outer rotor frame. The inner rotor magnet and the outer rotor magnet interact to generate a magnetic field therebetween to transfer torque from the outer rotor to the inner rotor such that, when the outer rotor rotates about the inner rotor, torque is transferred from the outer rotor to the inner rotor, thereby causing the anode to rotate.

In accordance with another aspect of the invention, a method of manufacturing an x-ray tube includes the steps of positioning a cathode in a vacuum chamber, positioning an anode within the vacuum chamber to receive electrons emitted from the cathode and generate a beam of x-rays, and attaching an inner rotor assembly that includes a first magnet to the anode within the vacuum chamber. The method also includes the step of positioning an outer rotor assembly outside the vacuum chamber and about the inner rotor assembly, the outer rotor assembly including a second magnet configured to interact with the first magnet to generate a magnetic field therebetween. The method further includes the step of attaching a drive motor to the outer rotor assembly outside the vacuum chamber to drive the outer rotor assembly.

In accordance with yet another aspect of the invention, an x-ray tube includes a housing enclosing a vacuum chamber, a cathode positioned within the vacuum chamber and configured to emit electrons, and an anode positioned within the vacuum chamber to receive the electrons emitted from the cathode and configured to generate a beam of x-rays from the electrons. The x-ray tube also includes a magnetic coupler drive configured to rotate the anode, with the magnetic coupler drive further including a drive motor configured to generate rotational power and an outer magnetic rotor assembly coupled to the drive motor to receive rotational power therefrom, the outer magnetic rotor assembly being positioned outside the housing. The magnetic coupler drive also includes an inner magnetic rotor assembly coupled to the anode by way of a bearing shaft and being positioned within the vacuum chamber adjacent the outer magnetic rotor assembly. The outer magnetic rotor assembly and the inner magnetic rotor assembly are configured so as to generate magnetic fields to transfer the rotational power from the outer rotor to the inner rotor.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION OF THE PREFERRED EMBODIMENT

Figure 1:
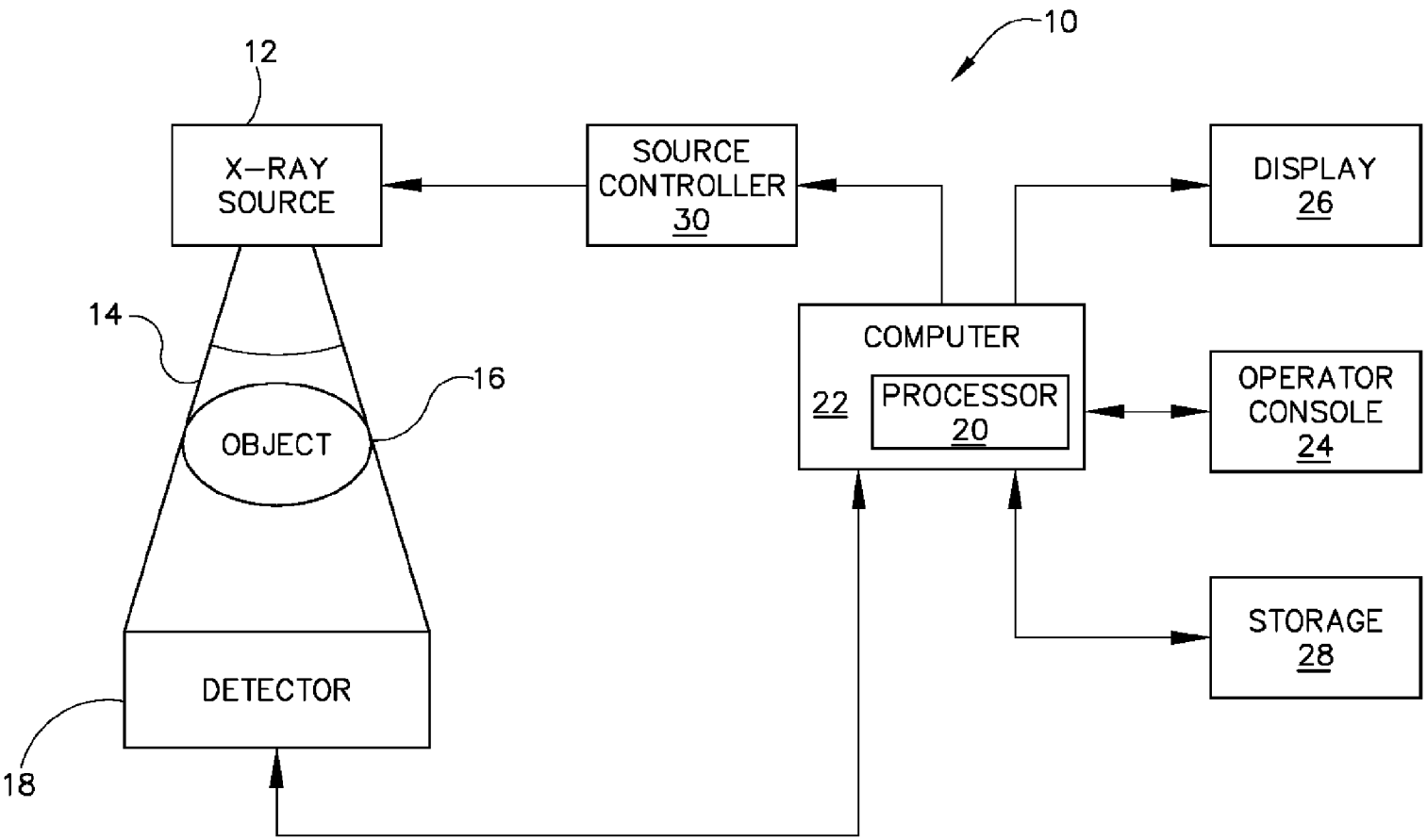
FIG. 1 is a block diagram of an imaging system that can benefit from incorporation of an embodiment of the present invention.

FIG. 1 is a block diagram of an embodiment of an imaging system 10 designed both to acquire original image data and to process the image data for display and/or analysis in accordance with the present invention. It will be appreciated by those skilled in the art that the present invention is applicable to numerous medical imaging systems implementing an x-ray tube, such as x-ray or mammography systems. Other imaging systems such as computed tomography systems and digital radiography systems, which acquire image three dimensional data for a volume, also benefit from the present invention. The following discussion of x-ray system 10 is merely an example of one such implementation and is not intended to be limiting in terms of modality.

As shown in FIG. 1, x-ray system 10 includes an x-ray source 12 configured to project a beam of x-rays 14 through an object 16. Object 16 may include a human subject, pieces of baggage, or other objects desired to be scanned. X-ray source 12 may be a conventional x-ray tube producing x-rays having a spectrum of energies that range, typically, from 30 keV to 200 keV. The x-rays 14 pass through object 16 and, after being attenuated by the object, impinge upon a detector 18. Each detector in detector 18 produces an analog electrical signal that represents the intensity of an impinging x-ray beam, and hence the attenuated beam, as it passes through the object 16. In one embodiment, detector 18 is a scintillation based detector, however, it is also envisioned that direct-conversion type detectors (e.g., CZT detectors, etc.) may also be implemented.

A processor 20 receives the analog electrical signals from the detector 18 and generates an image corresponding to the object 16 being scanned. A computer 22 communicates with processor 20 to enable an operator, using operator console 24, to control the scanning parameters and to view the generated image. That is, operator console 24 includes some form of operator interface, such as a keyboard, mouse, voice activated controller, or any other suitable input apparatus that allows an operator to control the x-ray system 10 and view the reconstructed image or other data from computer 22 on a display unit 26. Additionally, console 24 allows an operator to store the generated image in a storage device 28 which may include hard drives, floppy discs, compact discs, etc. The operator may also use console 24 to provide commands and instructions to computer 22 for controlling a source controller 30 that provides power and timing signals to x-ray source 12.

Figure 2:
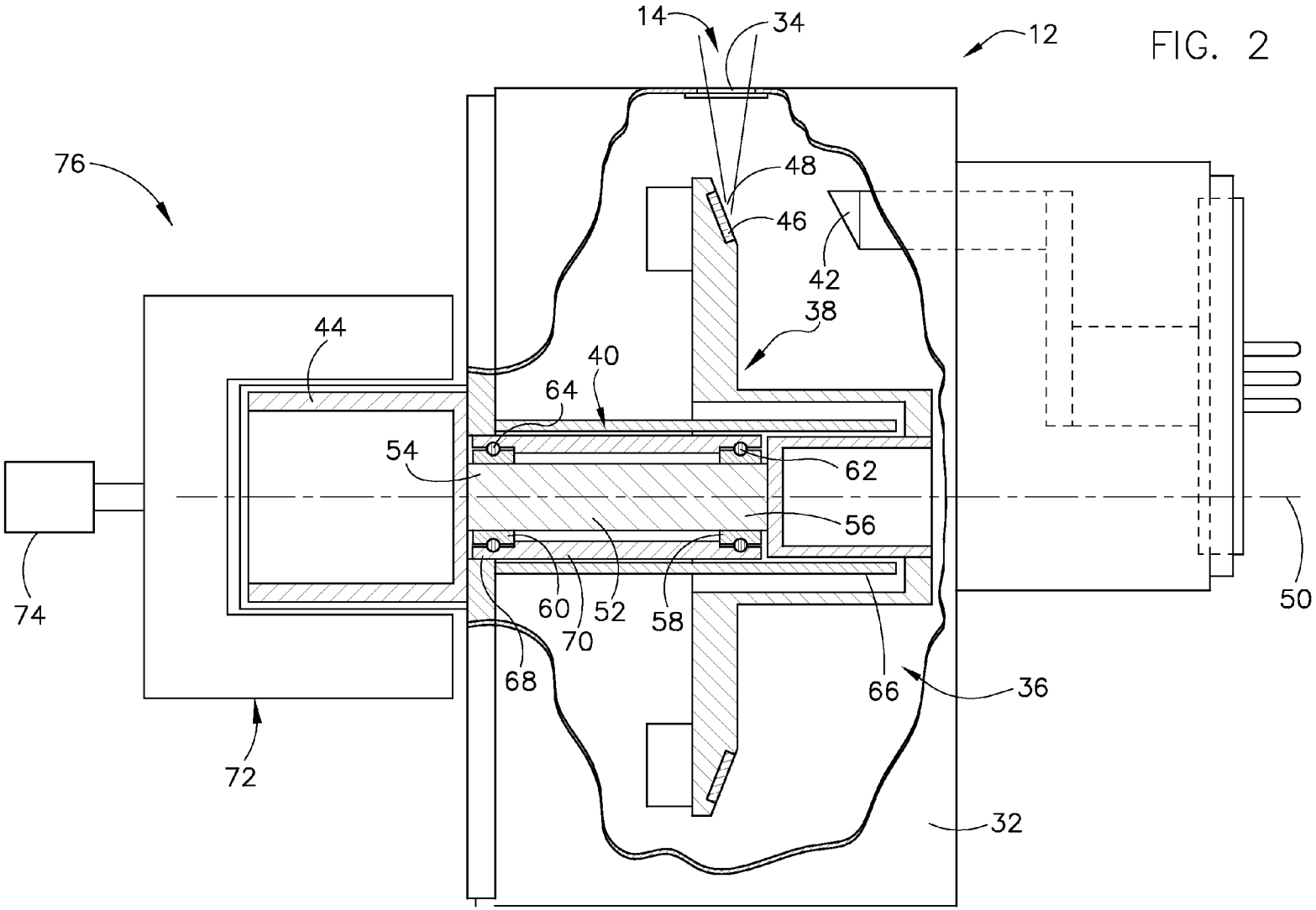
FIG. 2 is cross-sectional view of an x-ray tube useable with the system illustrated in FIG. 1 according to an embodiment of the present invention.

Referring now to FIG. 2, a cross-sectional view of an x-ray tube 12 is shown according to an exemplary embodiment of the present invention. While x-ray tube 12 is shown as incorporating cathode, anode, and bearing arrangements and/or structures described in detail below, it is recognized that x-ray tubes incorporating other varied cathode, anode, and bearing arrangements and/or structures are also within the scope of the invention. As such, the exemplary x-ray tube 12 shown in FIG. 2 incorporating the described cathode, anode, and bearing structures is not meant to limit the scope of the invention.

As shown in FIG. 2, x-ray tube 12 includes a casing or housing 32 having a radiation emission passage 34 formed therein. The casing 32 encloses a vacuum 36 and houses an anode 38, a bearing assembly 40, a cathode 42, and an inner rotor assembly 44. X-rays 14 are produced when high-speed electrons are suddenly decelerated when directed from the cathode 42 to the anode 38 via a potential difference therebetween of, for example, 60 thousand volts or more in the case of CT applications. The electrons impact a material layer 46 at focal point 48 and x-rays 14 emit therefrom. The point of impact is typically referred to in the industry as the track, which forms a circular region on the surface of the material layer 46, and is visually evident on the target surface after operation of the x-ray tube 12. The x-rays 14 emit through the radiation emission passage 34 toward a detector array, such as detector array 18 of FIG. 1. To avoid overheating the anode 38 from the electrons, the anode 38 is rotated at a high rate of speed about a centerline 50 at, for example, 90-250 Hz.

The bearing assembly 40 includes a center shaft 52 attached to the inner rotor assembly 44 at first end 54 and attached to the anode 38 at second end 56. A front inner race 58 and a rear inner race 60 rollingly engage a plurality of front balls 62 and a plurality of rear balls 64, respectively. Bearing assembly 40 also includes a front outer race 66 and a rear outer race 68 configured to rollingly engage and position, respectively, the plurality of front balls 62 and the plurality of rear balls 64. A stem 70 is also included in bearing assembly 40 and is supported by the x-ray tube 12.

As further shown in FIG. 2, an outer rotor assembly 72 is also included in x-ray tube 12 and is positioned outside of casing 32 adjacent to inner rotor assembly 44. A drive motor 74, such as a DC drive motor, is coupled to outer rotor assembly 72 and provides power thereto. The outer rotor assembly 72 is configured to interact with inner rotor assembly 44 so as to transfer torque from the outer rotor assembly 72 to the inner rotor assembly 44. The combination of inner rotor assembly 44 and outer rotor assembly 72, along with drive motor 74, thus forms a magnetic coupler drive 76 that rotationally drives anode 38.

Figure 3:
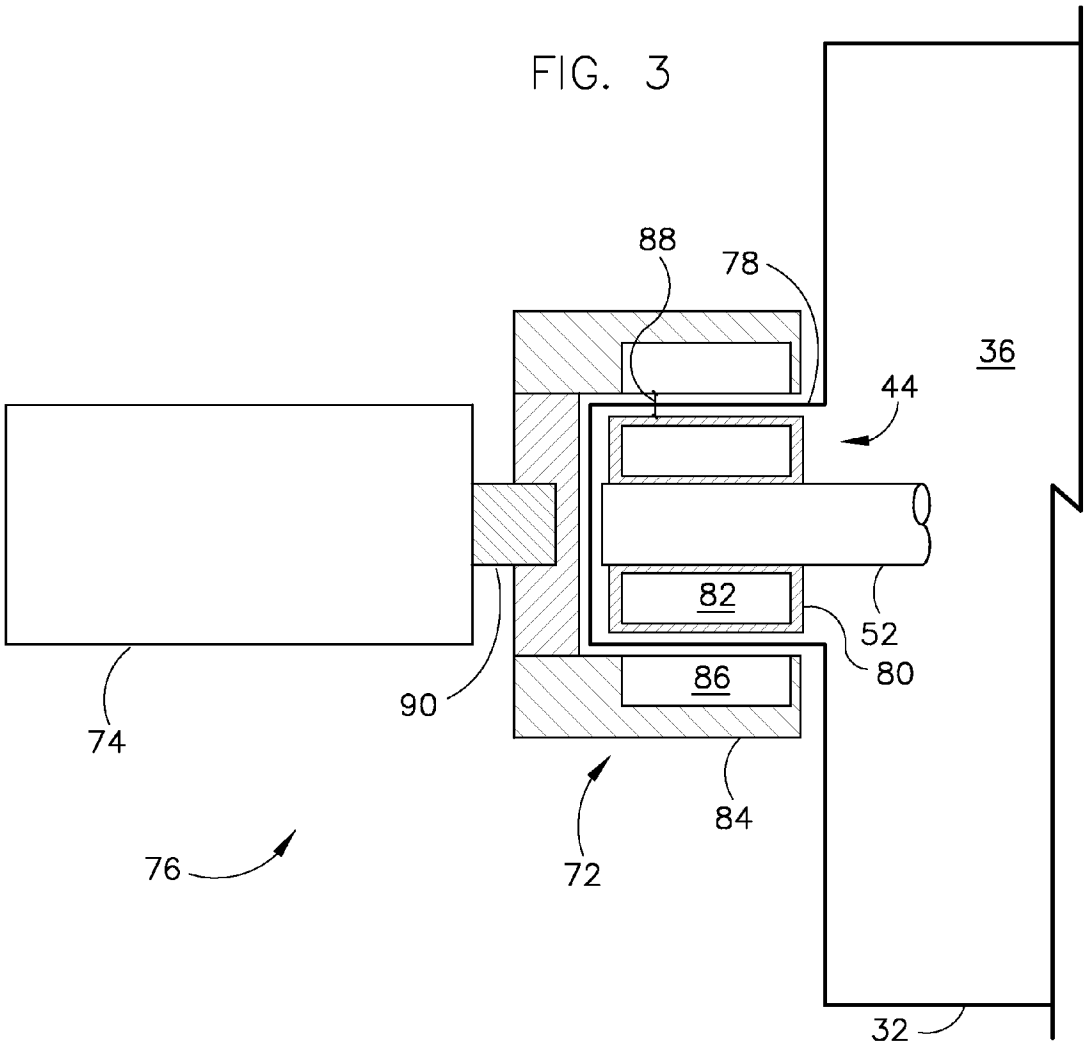
FIG. 3 is a cross-sectional view of a magnetic coupler drive incorporated into the x-ray tube of FIG. 2.

A detailed view of magnetic coupler drive 76 is shown in FIG. 3 according to an embodiment of the invention. As shown in FIG. 3, magnetic coupler drive 76 is formed such that a portion thereof is positioned inside the vacuum 36 of casing 32 and such that a portion thereof is positioned outside of casing 32. Specifically, magnetic coupler drive 76 is formed such that inner rotor assembly 44 resides within casing 32 and in vacuum 54 and outer rotor assembly 72 resides in air outside of casing 32. According to an exemplary embodiment, the inner rotor assembly 44 is positioned in a rotor can 78 of casing 32 that protrudes out from a remainder of the casing. The shaping of casing 32, and specifically of rotor can 78 protruding out from a remainder of the casing 32, thus provides for positioning of outer rotor assembly 72 adjacent to and about inner rotor assembly 44. According to an exemplary embodiment, rotor can 78 is constructed of a material through which magnetic fields can easily pass through, such as 304 stainless steel for example, or another similar material.

As shown in FIG. 3, inner rotor assembly 44 is constructed of an inner rotor frame 80 and an inner rotor magnet 82 mounted to/formed within the inner rotor frame. Similarly, outer rotor assembly 72 is constructed of an outer rotor frame 84 and an outer rotor magnet 86 mounted to/formed within the outer rotor frame. According to an exemplary embodiment, inner rotor frame 80 and outer rotor frame 84 are constructed of a material through which magnetic fields can easily pass through, such as 304-stainless steel or another similar material, such that a strong magnetic field is generated between inner rotor magnet 82 and outer rotor magnet 86. Furthermore, according to an exemplary embodiment, magnets 82, 86 are formed as permanent magnets, such as a samarium cobalt (SmCo2) permanent magnet, a neodymium (NdFeB) permanent magnet, or a iron core permanent magnet, for example. The inner rotor magnet 82 and the outer rotor magnet 86 mounted to inner rotor body 80 and outer rotor body 84, respectively, provide for the transmission of torque from outer rotor assembly 72 to inner rotor assembly 44, and thus subsequently to rotating anode bearing shaft 52.

The magnets 82, 86 of inner rotor assembly 44 and outer rotor assembly 72 are positioned adjacent one another, being separated by a wall of rotor can 78, and are radially aligned relative to bearing shaft 52 such that magnet 82 of inner rotor assembly 44 interacts with magnet 86 of outer rotor assembly 72 to generate a magnetic field therebetween and transmit torque from the outer rotor assembly 72, in air, to the inner rotor assembly 44 of the rotating anode bearing shaft 52, in vacuum 36. Accordingly, a gap 88 between the inner rotor assembly 44 and the outer rotor assembly 72 (i.e., rotor-rotor gap) is minimized to provide for an efficient transfer of torque from outer rotor assembly 72 to inner rotor assembly 44. Thus, according to an exemplary embodiment of the invention, the rotor-rotor gap 88 is formed to be approximately 5 mm in width.

In operation, drive motor 74 of magnetic coupler drive 76 provides rotational power or torque to outer rotor assembly 72 by way a drive shaft 90. Drive motor 74 may be configured as any known type of DC motor, for example. The transfer of rotational power to outer rotor assembly 72 by drive motor 74 (by way of drive shaft 90) thus causes outer rotor assembly 72 to rotate about inner rotor assembly 44. As outer rotor assembly 72 rotates about inner rotor assembly 44, the outer rotor magnet 86 is thus caused to rotate about inner rotor magnet 82. The rotation of outer rotor magnet 86 about inner rotor magnet 82 causes torque to be transferred from the outer rotor assembly 72 to the inner rotor assembly 44. That is, the magnetic field generated by the interaction between outer rotor magnet 86 and inner rotor magnet 82 provides for a transfer of torque from outer rotor assembly 72 to inner rotor assembly 44 upon rotation of the outer rotor magnet 86 about the inner rotor magnet 82.

The construction of magnetic coupler drive 76 as including a magnetic outer rotor assembly 72 and a magnetic inner rotor assembly 44 results in several advantages from a motor drive having a typical rotor-stator arrangement. For example, magnetic coupler drive 76 has a reduced size as compared to a typical rotor-stator arrangement. According to an exemplary embodiment, an inner diameter of the outer rotor frame 84 is between 60 and 90 mm. Additionally, as magnetic coupler drive 76 transfers torque from the outer rotor assembly 72 to the inner rotor assembly 44 by way of the interaction between outer rotor magnet 86 and inner rotor magnet 82, without the need to provide a "high" current to a stator, the magnetic coupler drive 76 generates no heat. The magnetic coupler drive 76 thus does not require cooling as opposed to stator windings of a typical rotor-stator arrangement, which must be cooled due to the large currents needed to overcome motor inefficiency. Furthermore, the magnetic coupler drive 76 operates at a lower power than typical rotor-stator drives based on the decreased size of the rotor-rotor gap 88 in the magnetic coupler drive 76. According to an exemplary embodiment, magnetic coupler drive 76 operates with a drive current provided to drive motor 74 on the order of 0.5 amps to 1 amp, as compared to the 5 amps to 17 amps needed to operate typical rotor-stator drives.

Figure 4:
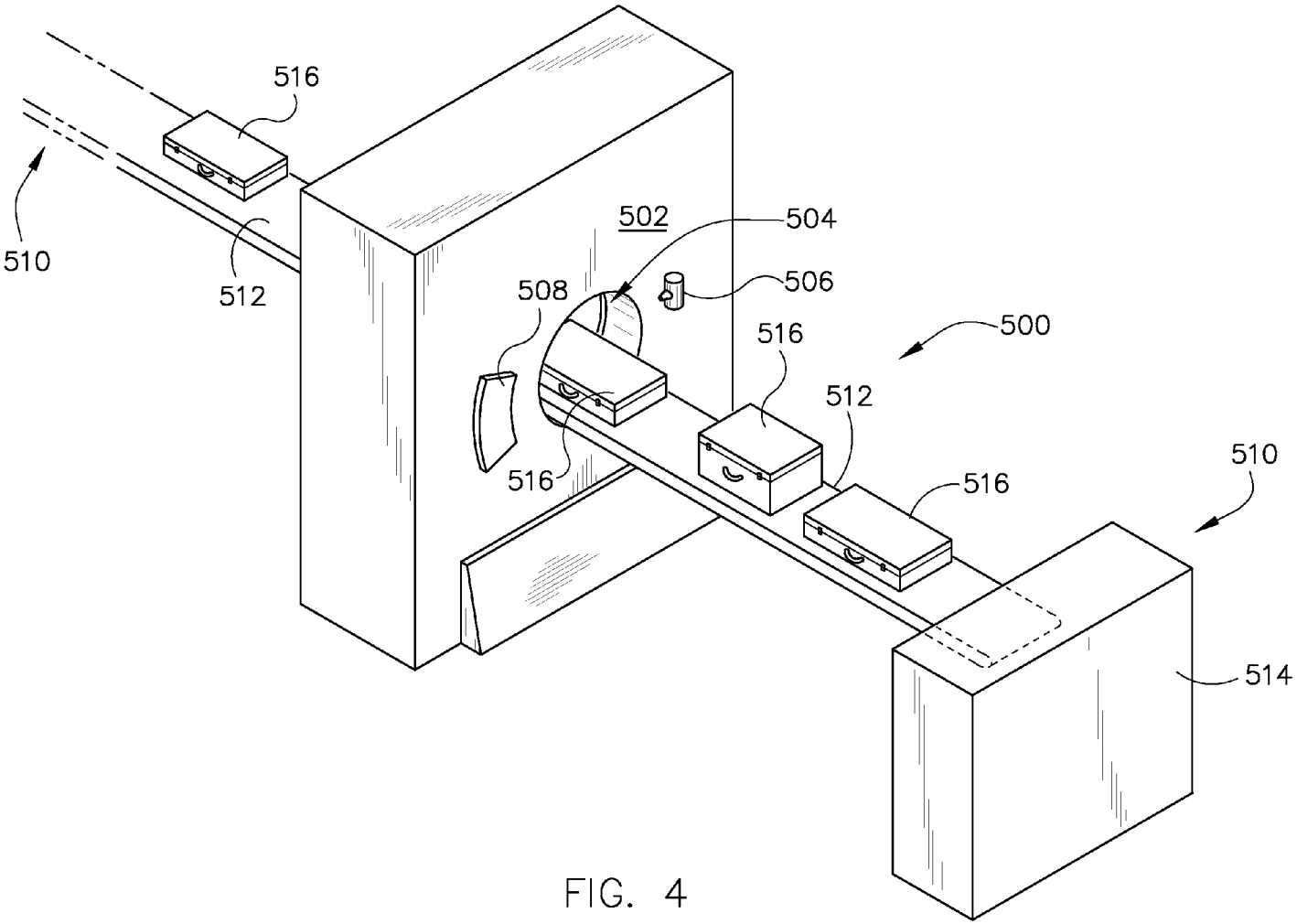
FIG. 4 is a pictorial view of a CT system for use with a non-invasive package inspection system.

According to an embodiment of the invention, x-ray tube 12 can be incorporated into an x-ray system, for example. FIG. 4 is a pictorial view of an x-ray system 500 for use with a non-invasive package inspection system. The x-ray system 500 includes a gantry 502 having an opening 504 therein through which packages or pieces of baggage may pass. The gantry 502 houses a high frequency electromagnetic energy source, such as an x-ray tube 506, and a detector assembly 508. A conveyor system 510 is also provided and includes a conveyor belt 512 supported by structure 514 to automatically and continuously pass packages or baggage pieces 516 through opening 504 to be scanned. Objects 516 are fed through opening 504 by conveyor belt 512, imaging data is then acquired, and the conveyor belt 512 removes the packages 516 from opening 504 in a controlled and continuous manner. As a result, postal inspectors, baggage handlers, and other security personnel may non-invasively inspect the contents of packages 516 for explosives, knives, guns, contraband, etc. One skilled in the art will recognize that gantry 502 may be stationary or rotatable. In the case of a rotatable gantry 502, system 500 may be configured to operate as a CT system for baggage scanning or other industrial or medical applications.

Therefore, according to one embodiment of the invention, an x-ray tube includes a housing enclosing a vacuum chamber, a cathode positioned within the vacuum chamber and configured to emit electrons, and an anode positioned within the vacuum chamber to receive the electrons emitted from the cathode and configured to generate a beam of x-rays from the electrons. The x-ray tube also includes a magnetic coupler drive configured to rotate the anode, the magnetic coupler drive further including an inner rotor frame positioned within the vacuum chamber and an outer rotor frame positioned outside the vacuum chamber and adjacent the inner rotor frame. The magnetic coupler drive also includes an inner rotor magnet mounted to the inner rotor frame and an outer rotor magnet mounted to the outer rotor frame. The inner rotor magnet and the outer rotor magnet interact to generate a magnetic field therebetween to transfer torque from the outer rotor to the inner rotor such that, when the outer rotor rotates about the inner rotor, torque is transferred from the outer rotor to the inner rotor, thereby causing the anode to rotate.

According to another embodiment of the invention, a method of manufacturing an x-ray tube includes the steps of positioning a cathode in a vacuum chamber, positioning an anode within the vacuum chamber to receive electrons emitted from the cathode and generate a beam of x-rays, and attaching an inner rotor assembly that includes a first magnet to the anode within the vacuum chamber. The method also includes the step of positioning an outer rotor assembly outside the vacuum chamber and about the inner rotor assembly, the outer rotor assembly including a second magnet configured to interact with the first magnet to generate a magnetic field therebetween. The method further includes the step of attaching a drive motor to the outer rotor assembly outside the vacuum chamber to drive the outer rotor assembly.

According to yet another embodiment of the invention, an x-ray tube includes a housing enclosing a vacuum chamber, a cathode positioned within the vacuum chamber and configured to emit electrons, and an anode positioned within the vacuum chamber to receive the electrons emitted from the cathode and configured to generate a beam of x-rays from the electrons. The x-ray tube also includes a magnetic coupler drive configured to rotate the anode, with the magnetic coupler drive further including a drive motor configured to generate rotational power and an outer magnetic rotor assembly coupled to the drive motor to receive rotational power therefrom, the outer magnetic rotor assembly being positioned outside the housing. The magnetic coupler drive also includes an inner magnetic rotor assembly coupled to the anode by way of a bearing shaft and being positioned within the vacuum chamber adjacent the outer magnetic rotor assembly. The outer magnetic rotor assembly and the inner magnetic rotor assembly are configured so as to generate magnetic fields to transfer the rotational power from the outer rotor to the inner rotor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An x-ray tube comprising:

a housing enclosing a vacuum chamber;

a cathode positioned within the vacuum chamber and configured to emit electrons;

an anode positioned within the vacuum chamber to receive the electrons emitted from the cathode and configured to generate a beam of x-rays from the electrons; and a magnetic coupler drive configured to rotate the anode, the magnetic coupler drive comprising:

an inner rotor frame positioned within the vacuum chamber;

an outer rotor frame positioned outside the vacuum chamber and adjacent the inner rotor frame;

an inner rotor magnet formed within the inner rotor frame so as to be surrounded by the inner rotor frame; and an outer rotor magnet formed within the outer rotor frame so as to be surrounded by the outer rotor frame;

wherein the inner rotor magnet and the outer rotor magnet interact to generate a magnetic field therebetween to transfer torque from the outer rotor to the inner rotor such that, when the outer rotor rotates about the inner rotor, torque is transferred from the outer rotor to the inner rotor, thereby causing the anode to rotate.

2. The x-ray tube of claim 1 wherein the inner rotor magnet and the outer rotor magnet comprise permanent magnets.

3. The x-ray tube of claim 1 wherein the outer rotor is positioned about the inner rotor such that the outer rotor magnet is positioned adjacent the inner rotor magnet.

4. The x-ray tube of claim 1 wherein a gap between the outer rotor and the inner rotor is approximately 5 mm or less.

5. The x-ray tube of claim 1 further comprising a motor drive coupled to the outer rotor by way of a drive shaft, the motor drive configured to provide torque to the outer rotor.

6. The x-ray tube of claim 5 wherein the motor drive comprises an electric motor drive configured to be driven by a drive current of 0.5 to 1.0 amps.

7. The x-ray tube of claim 5 wherein the torque provided to the outer rotor by the motor drive is transferred to the inner rotor by way of the magnetic field between the inner rotor magnet and the outer rotor magnet.

8. The x-ray tube of claim 1 wherein an inner diameter of the outer rotor is between 60 and 90 mm.

9. The x-ray tube of claim 1 wherein the housing includes a rotor can positioned about the inner rotor to house the inner rotor therein.

10. The x-ray tube of claim 9 wherein the rotor can, the inner rotor frame, and the outer rotor frame are formed of stainless steel, such that the magnetic field generated between the inner rotor magnet and the outer rotor magnet can pass through the rotor can, the inner rotor frame, and the outer rotor frame.

11. A method of manufacturing an x-ray tube comprising:

positioning a cathode in a vacuum chamber;

positioning an anode within the vacuum chamber to receive electrons emitted from the cathode and generate a beam of x-rays;

attaching an inner rotor assembly to the anode within the vacuum chamber, the inner rotor assembly including a first magnet formed within a inner rotor frame;

positioning an outer rotor assembly outside the vacuum chamber and about the inner rotor assembly, the outer rotor assembly including a second magnet formed within an outer rotor frame and being configured to interact with the first magnet to generate a magnetic field therebetween; and attaching a drive motor to the outer rotor assembly outside the vacuum chamber to drive the outer rotor assembly.

12. The method of claim 11 wherein the first magnet and the second magnet comprise permanent magnets.

13. The method of claim 11 wherein the magnetic field generated between the first magnet of the inner rotor assembly and the second magnet of the outer rotor assembly is configured to transfer torque generated by the drive motor from the outer rotor assembly to the inner rotor assembly.

14. The method of claim 11 wherein positioning the outer rotor assembly about the inner rotor assembly comprises positioning the outer rotor assembly about the inner rotor assembly such that a gap between the outer rotor assembly and the inner rotor assembly is approximately 5 mm or less.

15. The method of claim 11 wherein positioning the outer rotor assembly about the inner rotor assembly comprises positioning the outer rotor assembly about the inner rotor assembly such that the second magnet of the outer rotor assembly is positioned adjacent the first magnet of the inner rotor assembly.

16. An x-ray tube comprising:

a housing enclosing a vacuum chamber;

a cathode positioned within the vacuum chamber and configured to emit electrons;

an anode positioned within the vacuum chamber to receive the electrons emitted from the cathode and configured to generate a beam of x-rays from the electrons; and a magnetic coupler drive configured to rotate the anode, the magnetic coupler drive comprising:

a drive motor configured to generate rotational power;

an outer magnetic rotor assembly coupled to the drive motor to receive rotational power therefrom, the outer magnetic rotor assembly positioned outside the housing; and an inner magnetic rotor assembly coupled to the anode by way of a bearing shaft and being positioned within the vacuum chamber adjacent the outer magnetic rotor assembly;

wherein the outer magnetic rotor assembly and the inner magnetic rotor assembly generate magnetic fields to transfer the rotational power from the outer rotor to the inner rotor; and wherein each of the inner magnetic rotor assembly and the outer magnetic rotor assembly comprise:

a rotor frame; and a permanent magnet mounted within the rotor frame so as to be surrounded thereby;

wherein the rotor frame is composed of stainless steel such that the rotor frame is configured to allow the passage of the magnetic fields therethrough.

17. The x-ray tube of claim 16 wherein the rotor frame of the outer magnetic rotor assembly is positioned about the rotor frame of the inner magnetic rotor assembly such that the permanent magnet of the outer magnetic rotor assembly is radially aligned with the permanent magnet of the inner magnetic rotor assembly relative to the bearing shaft.

18. The x-ray tube of claim 16 wherein a gap between the permanent magnet of the outer magnetic rotor assembly and the permanent magnet of the inner magnetic rotor assembly is less than 5 mm.

* * * * *